US005556310A

United States Patent [19]

Gandarillas

[11] Patent Number: 5,556,310

[45] Date of Patent: Sep. 17, 1996

[54] PROTECTIVE ASSEMBLY FOR THE STEERING RAM OF A MARINE OUTBOARD MOTOR

[76] Inventor: Michael J. Gandarillas, 305 Bull Run Dr., Hopewell, Va. 23860

[21] Appl. No.: 576,512

[22] Filed: Dec. 21, 1995

[51] Int. Cl.[6] ..... B63H 5/12

[52] U.S. Cl. ..... 440/61

[58] Field of Search ..... 440/49, 53, 56, 440/57, 58, 59, 63, 61, 75; 267/182

[56] References Cited

U.S. PATENT DOCUMENTS

| | | | |
|---|---|---|---|
| 3,626,467 | 12/1971 | Mazziotti . | |
| 3,901,177 | 8/1975 | Scott . | |
| 4,493,656 | 1/1985 | Inoue et al. | 440/53 |
| 4,897,057 | 1/1990 | McCormick | 440/57 |
| 4,929,203 | 5/1990 | Hahn | 440/57 |
| 4,940,434 | 7/1990 | Kiesling | 440/57 |
| 4,963,109 | 10/1990 | Hayasaka | 440/75 |
| 5,238,432 | 8/1993 | Renner | 440/56 |

*Primary Examiner*—Stephen Avila
*Attorney, Agent, or Firm*—Norman B. Rainer

[57] ABSTRACT

A boot system interactive with an access port of a marine outboard engine and adapted to protectively enclose an elongated steering component emergent from the access port includes an elongated resilient hollow boot and an internally threaded receiving nut which engages the access port. The boot has an accordion-pleated wall portion elongated upon a center axis and terminating in first and second attachment sleeves. The first sleeve grips the steering component. The second sleeve has an inwardly directed annular abutment shoulder that fits onto a recessed annular groove on the receiving nut. Self-locking plastic straps compress the first sleeve onto the steering component and the second sleeve onto the receiving nut.

5 Claims, 1 Drawing Sheet

PROTECTIVE ASSEMBLY FOR THE STEERING RAM OF A MARINE OUTBOARD MOTOR

BACKGROUND OF THE INVENTION

1. Field of the Invention

This invention concerns a marine outboard motor, and more particularly relates to an assembly which prevents water contact with steering components extending between an outboard motor and the boat to which it is attached.

2. Description of the Prior Art

Marine outboard motors are typically mounted upon the transom of a boat and adapted to be turnable upon a substantially vertical axis. A propeller adapted to rotate on a substantially horizontal axis, is positioned at the lower, immersed extremity of the motor. A steering ram extends from the transom to said motor to control the pivotal positioning of the motor, thereby controlling the direction in which the vessel is propelled.

The ram is generally a mechanical cable-operated cylinder-ram combination of telescopically adjustable length, and extends between a first extremity proximal to the transom, and a second or distal extremity associated with said motor. The ram may further rotatively interact with geared steering components or universal joints. The ram is often closely associated with a tilt mechanism which adjusts the trim of the propeller position relative to the boat. Failures or difficulties concerning the steering function are typically attributable to a dirty, corroded or frozen steering ram. Dirt, contaminated grease, salt deposits and marine growth quickly accumulate on the ram due to its generally unprotected exposure to the environment.

A device, referred to as a "boot", has earlier been proposed for protectively enclosing control components such as the steering ram that extend between the engine and propulsion housing of an inboard-outboard engine. For example, U.S. Pat. 3,626,467 discloses an elongated seal element of accordion-pleated structure fabricated of resilient thick neoprene. The seal element surrounds a steering mechanism, providing therefor a watertight enclosure extending between the lower housing and engine or transom.

U.S. Pat. 3,901,177 discloses an accordion-pleated elongated flexible rubber boot providing a watertight seal about components that raise and lower a propeller housing.

U.S. Pat. 4,493,656 discloses a flexible bellows extending between a transom and a propeller housing for the purpose of establishing a watertight enclosure for a drive shaft that transmits power to the propeller.

U.S. Pat. 4,963,109 discloses a flexible boot that encircles a universal joint and provides a protective seal between a transom and an outboard drive unit.

U.S. Pat. 5,238,432 discloses the use of two flexible boots, one for protecting a steering mechanism extending between the transom and rearward engine housing, and another for protecting a drive shaft interactive between said housing and a pendent propeller housing.

One of the difficulties encountered in employing the aforesaid boots is that they tend to separate from their sites of attachment. This is caused by the extreme vibration experienced by the boot, combined with the effects of water immersion, contact with oil, and cycling between wet and dry conditions. The two opposite extremities of the boot are usually contoured as circular cylindrical sleeves adapted to slip onto a correspondingly sized and shaped mechanical feature of marine outdrive systems. Once employed, the sleeve extremities are usually secured in place by an encircling band clamp. However, the thin construction of the boot often permits the boot to squirm loose from the clamp. If the clamp is overly tightened to prevent escape of the boot, damage to the boot is often encountered.

It is accordingly an object of the present invention to provide a boot system for protectively enclosing steering components associated with a marine outboard motor.

It is a further object of this invention to provide a boot system as in the foregoing object which easily and securely attaches to standard mechanical receiving elements of the motor.

It is a still further object of this invention to provide a boot system of the aforesaid nature of simple, rugged construction amenable to low cost manufacture.

These objects and other objects and advantages of the invention will be apparent from the following description.

SUMMARY OF THE INVENTION

The above and other beneficial objects and advantages are accomplished in accordance with the present invention by a boot system interactive with an access port of a marine outboard motor and adapted to protectively enclose an elongated steering component emergent from said port, said boot system comprising:

1) a resilient hollow boot of monolithic construction having an accordion-pleated wall portion of circular cross-sectional configuration elongated upon a center axis between opposed first and second extremities having first and second attachment sleeves, respectively, of thicker construction than the wall of said accordion-pleated portion and bounded by axially spaced innermost and outermost extremities and radially spaced internal and external surfaces, said first sleeve having a circular cylindrical internal surface configuration centered upon said axis and an external surface configuration having a circular cylindrical shoulder and an outwardly directed flange positioned at said outermost extremity, said second sleeve having an inwardly directed annular abutment shoulder contiguous with said outermost extremity and a first annular groove inwardly recessed from said external surface, and 2) an internally threaded receiving nut adapted to threadably engage said access port and bounded by axially spaced forward and rearward extremities and radially spaced internal and external surfaces, said external surface having a hexagonal contour adjacent said forward extremity, and a second recessed annular groove positioned adjacent said rearward extremity and configured to receive the annular abutment shoulder of said second sleeve.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
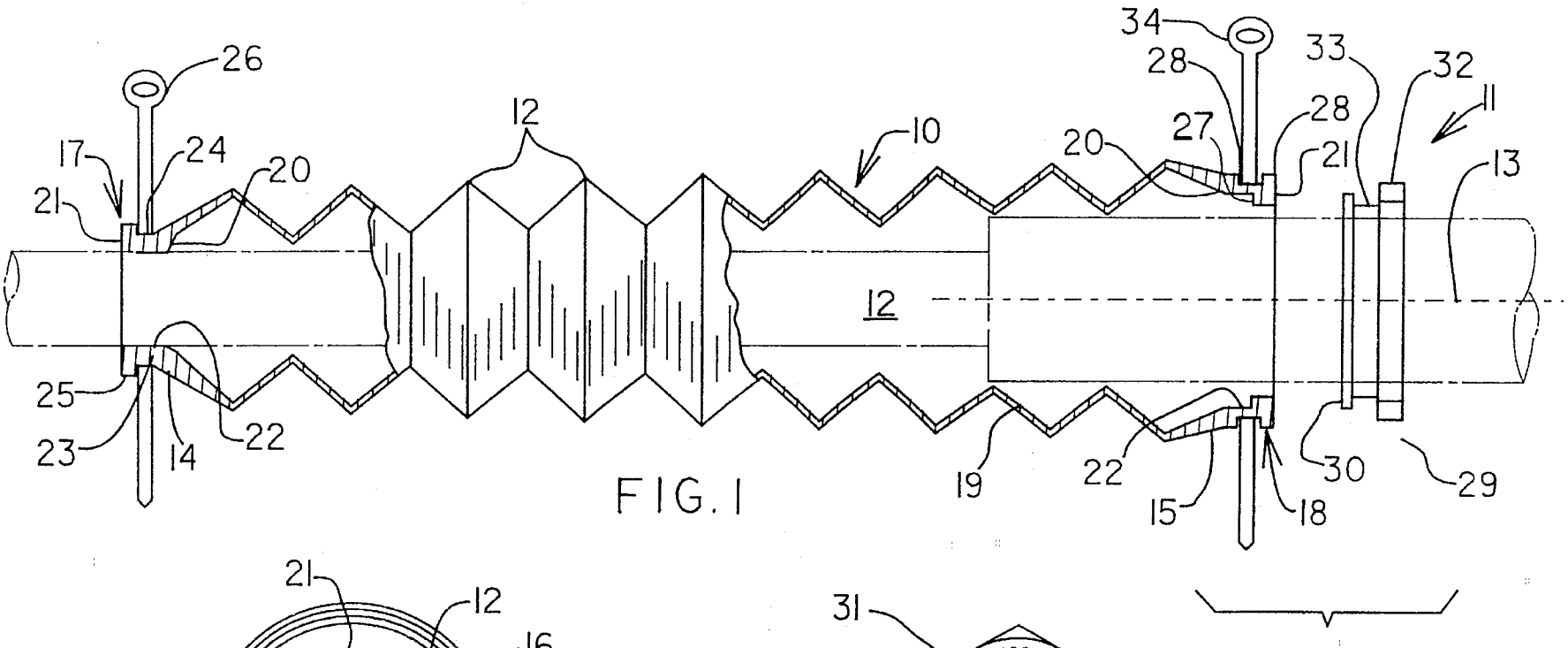
FIG. 1 is an exploded sectional side view of an embodiment of the boot system of the present invention.
Figure 3:
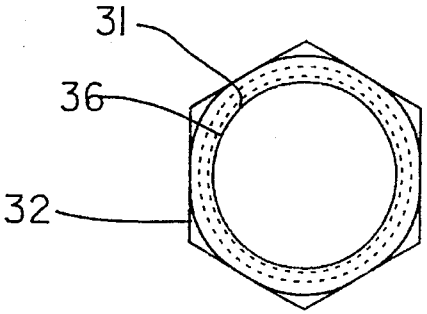
FIG. 3 is a front end view taken from the right of FIG. 1.
Figure 2:
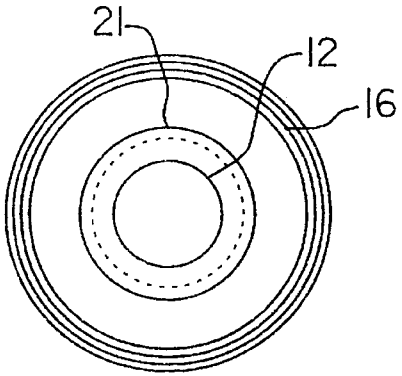
FIG. 2 is a rear end view taken from the left of FIG. 1.

Referring now to FIGS. 1–3, an embodiment of the boot system of the present invention is shown comprised of boot 10 and receiving nut 11, said system being deployed upon a steering ram 12 of conventional construction.

Boot 10 is fabricated of a resilient, durable material such as neoprene rubber, and is of generally circular cross-sectional configuration, having an accordion-pleated bellows portion 19.

The boot is elongated upon center axis 13 between opposed first and second extremities 14 and 15, respectively. Although the illustrated embodiment of the boot is shown to have a bellows section of uniform cross-sectional contour, alternative embodiments may have a tapering contour between said extremities. The number of pleats 16 within said bellows portion may range between about 7 and 12. The thickness of the neoprene rubber in said bellows portion is in the range of 0.5 to 2.0 millimeters.

First and second attachment sleeves 17 and 18, respectfully, are associated with said first and second extremities 14 and 15, respectfully, as continuous integral extensions of bellows portion 19. Said sleeves are of thicker construction than the bellows portion and are bounded by axially spaced innermost and outermost extremities 20 and 21, respectfully, and radially spaced internal and external arcuate surfaces, 22 and 23, respectively.

The internal surface 22 of first sleeve 17 is of circular cylindrical configuration centered upon axis 13 and adapted to tightly embrace steering ram 12. The external surface 23 of first sleeve 17 has a circular cylindrical shoulder 24, and an outwardly directed circular flange 25 positioned at outermost extremity 21. When emplaced upon said steering ram, sleeve 17 is secured by means of a self-locking plastic strap 26 which embraces shoulder 24.

Second sleeve 18 has an inwardly directed annular abutment shoulder 27 contiguous with outermost extremity 21. The external surface 23 of second sleeve 18 is provided with a first recessed annular groove 28. Both attachment sleeves are integral with said bellows portion by way of having been made in a molding operation that fabricates the sleeves and bellows portion as a single monolithic structure.

Receiving nut 11 is provided with internal threading 36 of a nature to engage the conventional threaded male access port of the motor (not shown). The nut is preferably size ⅞×14, and the internal threading is preferably standard fine thread. The nut may contain a locking nylon insert, and is sometimes referred to as a "tilt-tube" nut. Receiving nut 11 may be used in place of the conventional tilt-tube nut, or may fit onto or adjacent the existing tilt-tube nut. Receiving nut 11 is bounded by axially spaced forward and rearward extremities 29 and 30, respectively, and radially spaced internal and external surfaces, 31 and 32, respectfully. Said external surface 32 has a hexagonal contour adjacent forward extremity 29, and contains second recessed annular groove 33 adjacent rearward extremity 30. The size and configuration of groove 33 is such as to closely accommodate abutment shoulder 27 of said second sleeve. When abutment shoulder 27 is engaged with groove 33, a self-locking strap 34, seated within first groove 28, is utilized to secure the engaged members.

By virtue of the aforesaid components and their manner of interaction and use, a boot system is provided which is easily installable and provides a durable watertight enclosure for the steering ram.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A boot system interactive with an access port of a marine outboard motor and adapted to protectively enclose an elongated steering component emergent from said port, said boot system comprising:

A) a resilient hollow boot of monolithic construction having an accordion-pleated wall portion of circular cross-sectional configuration elongated upon a center axis between opposed first and second extremities having first and second attachment sleeves, respectively, of thicker construction than the wall of said accordion-pleated portion and bounded by axially spaced innermost and outermost extremities and radially spaced internal and external surfaces, said first sleeve having a circular cylindrical internal surface configuration centered upon said axis and an external surface configuration having a circular cylindrical shoulder and an outwardly directed flange positioned at said outermost extremity, said second sleeve having an inwardly directed annular abutment shoulder contiguous with said outermost extremity and a first annular groove inwardly recessed from said external surface, and B) an internally threaded receiving nut adapted to threadably engage said access port and bounded by axially spaced forward and rearward extremities and radially spaced internal and external surfaces, said external surface having a hexagonal contour adjacent said forward extremity, and a second recessed annular groove axially positioned between said forward and rearward extremities and configured to receive the annular abutment shoulder of said second sleeve.

2. The system of claim 1 wherein said accordion-pleated portion contains between 7 and 12 pleats and has a wall thickness in the range of 0.5 to 2.0 millimeters.

3. The system of claim 2 wherein said first and second attachment sleeves are continuous integral extensions of said accordion-pleated wall portion.

4. The system of claim 3 wherein the diameter of the circular cylindrical internal surface of said first sleeve is such as to tightly embrace said elongated steering component.

5. The system of claim 4 further comprising at least two self-locking plastic straps adapted to tightly embrace the external surface of said first sleeve and the first annular groove of said second sleeve.

* * * * *